United States Patent [19]

Cowan

[11] 4,391,582

[45] Jul. 5, 1983

[54] FUEL NOZZLE WITH CONCENTRIC IGNITOR

[76] Inventor: Frederick C. Cowan, 82 Cove Rd., Oyster Bay Cove, N.Y. 11771

[21] Appl. No.: 248,909

[22] Filed: Mar. 30, 1981

[51] Int. Cl.[3] ..... F23Q 3/00

[52] U.S. Cl. ..... 431/266

[58] Field of Search ..... 431/266; 361/253

[56] References Cited

U.S. PATENT DOCUMENTS 2,563,625 8/1951 Smits ..... 361/253
3,155,140 11/1964 Wilson ..... 431/266 X
3,167,109 1/1965 Wobig ..... 431/266 X
3,558,251 1/1971 Bauger et al. ..... 431/266

FOREIGN PATENT DOCUMENTS 421854 8/1974 U.S.S.R. ..... 431/266

*Primary Examiner*—Edward G. Favors
*Attorney, Agent, or Firm*—Richard G. Geib

[57] ABSTRACT

An electric ignitor to be used for fuel mixture ignition that delivers fuel through a fuel nozzle having integral concentric electrodes arranged such that radiated fuel from the nozzle washes a power arc providing required light-off energy.

12 Claims, 5 Drawing Figures

FUEL NOZZLE WITH CONCENTRIC IGNITOR

BACKGROUND

This invention relates to electric arc ignitors that transform high energy from an AC source and rectify it to DC energy that is supplied to a capacitive discharge circuit to provide a controllable pulsating arc across the tip of a fuel nozzle for fuel ignition to light-off a combustion chamber.

SUMMARY

Combustion systems for building heating systems and vehicle propulsion means have been the subject of many recent improvements to increase combustion efficiency and completeness. The drivers of such improvements have been the need to conserve fuel and to clean-up the environment.

In many instances these improvements have involved the improving of the flow dynamics for fuel and air into the combustion chamber others have addressed the problem of ignition.

A principle object of this invention is in the improvement of ignition means for a combustion system.

A more particular object of this invention is in the improvement of a direct energy ignition system so as to integrate a fuel nozzle and power arc electrodes so as to insure the excitation of the power arc in the flow path of the fuel.

A still further object of this invention is to adapt it in structure that will permit its incorporation into existing combustion systems without extensive, costly modifications.

DRAWING DESCRIPTION

DETAILED DESCRIPTION

Figure 1:
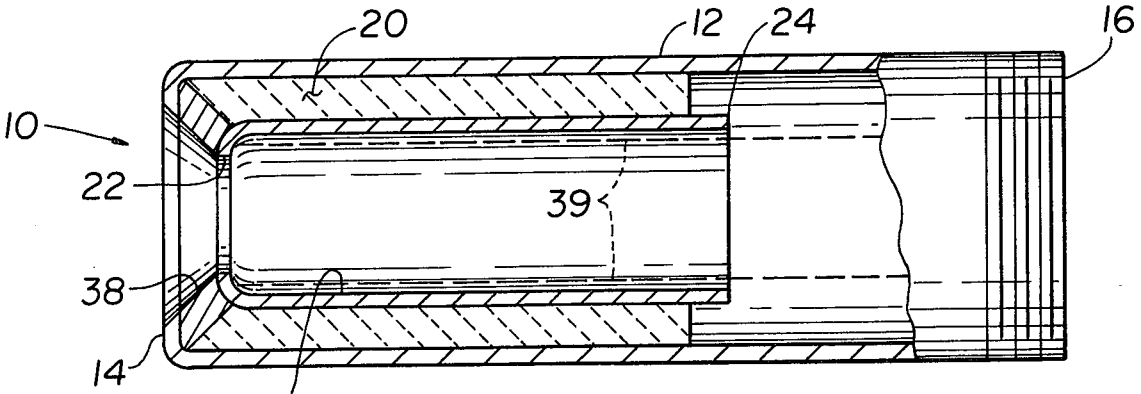
FIG. 1 is a broken sectional of a fuel nozzle tip incorporating the principles of this invention.

With particular regard to FIG. 1 there is shown a fuel nozzle 10 according to this invention having an outer tubular shell 12 with turned-in end 14 and a threaded end 16. An inner tubular member 18 is located behind the turned-in end 14 and spaced inwardly of tube 12 by means of an insulator body 20. In a preferred embodiment the inner and outer surfaces of the body 20 is adhesively secured to the inner and outer surfaces of tubes 12 and 18, respectively. As seen the inner tube also has a turned-in end 22 and an open end 24 for telescopic assembly over a fuel delivery conduit as set forth hereinafter.

Figure 2:
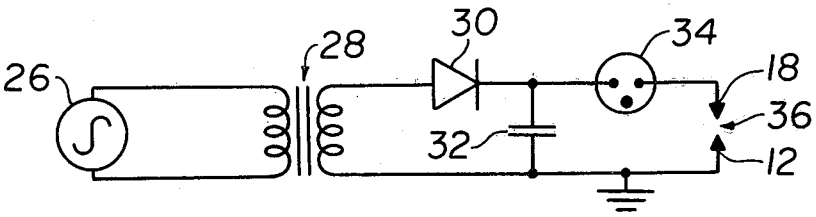
FIG. 2 is a circuit diagram of a capacitor discharge sparking circuit.

An electrical source is shown in FIG. 2 that is operatively associated with the nozzle structure of FIG. 1. Specifically an AC source 26 is connected by a transform 28 to a rectifier circuit including diode 30 and capacitance 32 connected by an ionization tube 34 to the inner tube 18 and the circuit is commonly grounded with the outer tube 12. This will provide an area 36 across the turned-in ends 22 and 14 for the development of an arc. A conductive path for such area 36 is provided across the end of the insulator body 20 by means of a conductive annular facing 38 at the end of body 20 between the turned-in ends 22 and 14. In this a fuel oil delivery tube 39 abuts the end 22 to provide electrical continuity in the connection of the positive potential to the inner tube 18. This will be further explained with reference to FIG. 4.

Figure 3:
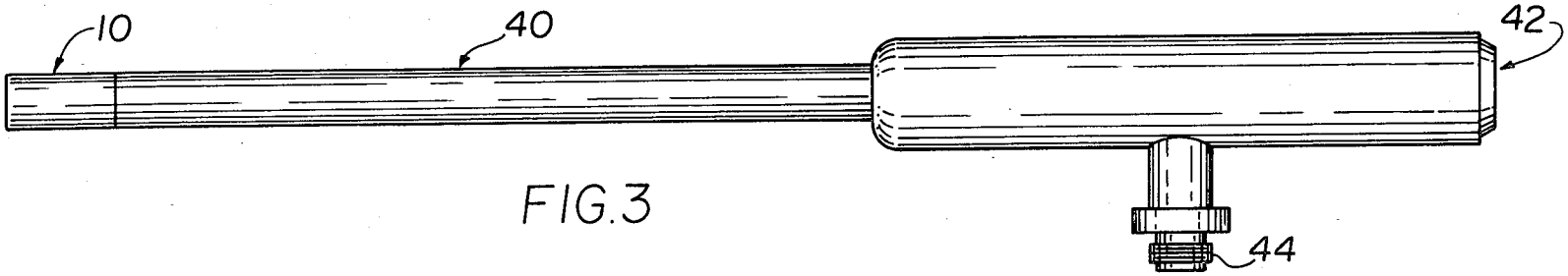
FIG. 3 is a side view of an ignitor lance incorporating the fuel nozzle and ignitor of this invention.

The completed assembly of nozzle 10 and an ignitor lance 40 is shown in FIG. 3. This assembly has provision for connection to a fuel delivery source, as at 42, and to the rectifier circuit, as at 44. Such connections will be standard tubing and bayonet type, respectively, readily familiar to those skilled in the art. This will be more readily apparent from the description of the FIG. 4 embodiment, as shall now follow.

Figure 4:
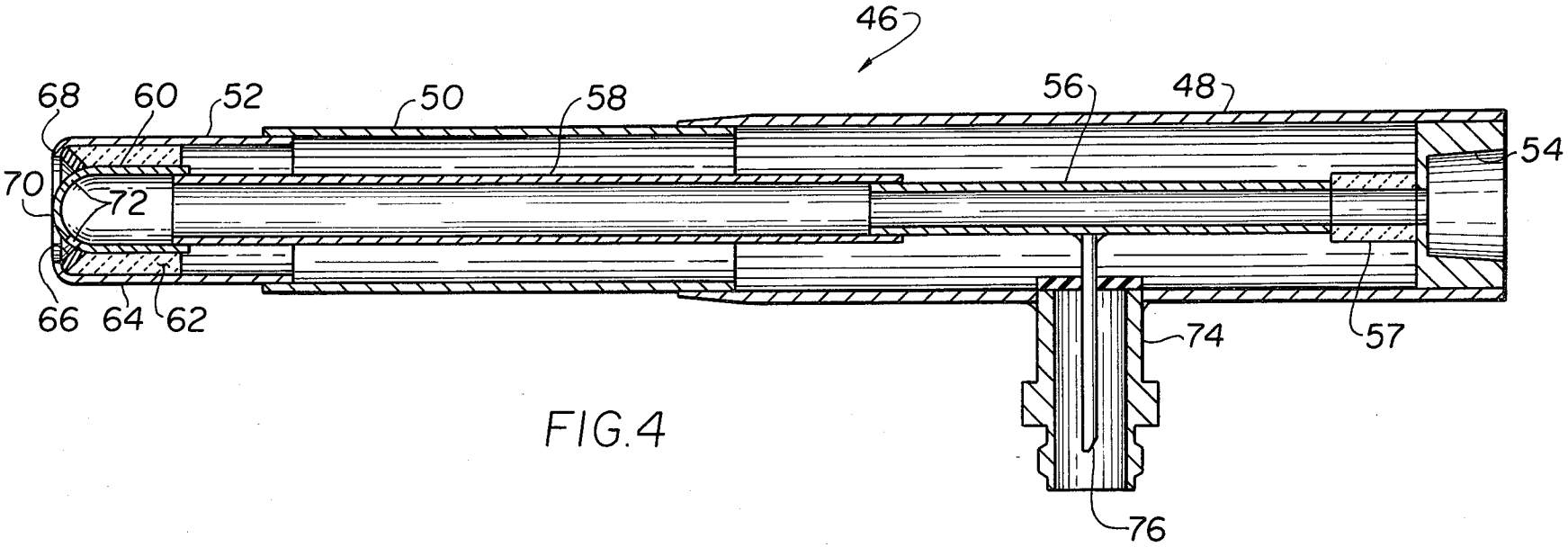
FIG. 4 is a cross-sectioned side view of an alternative ignitor lance assembly incorporating the concentric electrodes in a fuel nozzle according to the principles of this invention; and, FIG. 5 is a cross-sectioned side view of still another alternative form embodying the principles of this invention.

With more particular regard to FIG. 4 there is shown thereby an ignitor lance assembly 46 having a housing 48, a probe 50 and a concentric fuel nozzle ignitor 52. A fuel supply within the lance 46 includes an inlet fitting 54 connected to a housing tube 56 by a ceramic tubular post 57 that telescopes within a probe tube 58 which in turn telescopes within the inner tube 60 of the nozzle 52 as the assembly is made by threading the probe 50 to the housing 48 and the nozzle 52 to the probe 50.

In this embodiment, as with the nozzle of FIG. 1, an insulator body 62 orients and holds the inner tubular member 60 relative to outer tubular shell 64. A conductive tip 66 provides a path between the down-turned ends 68 of the outer tube 60 and the end 70 of the inner tube 60. The end 70 is drilled or slotted to have orifices 72 to radiate the fuel within the delivery system to wash the conductive path for the power arc from tube 60 to end 68.

In order to power the ignitor tip a plus in socket electrical fitting 74 is joined with the housing 48. A male connector 76 will provide a path for the positive potential while the housing forms the path to the ground potential via the fitting housing 74. In this form the fuel within the fuel delivery system is used to conduct the positive potential to the inner tube 60.

With such a structure as afforded by the assembly of FIG. 3 and that of FIG. 4 the power arc's hottest portion being at the point of origin from the inside tube member is closest to the fuel delivery whereby fast and complete ignition is more readily obtainable to light-off a combustion system.

Figure 5:
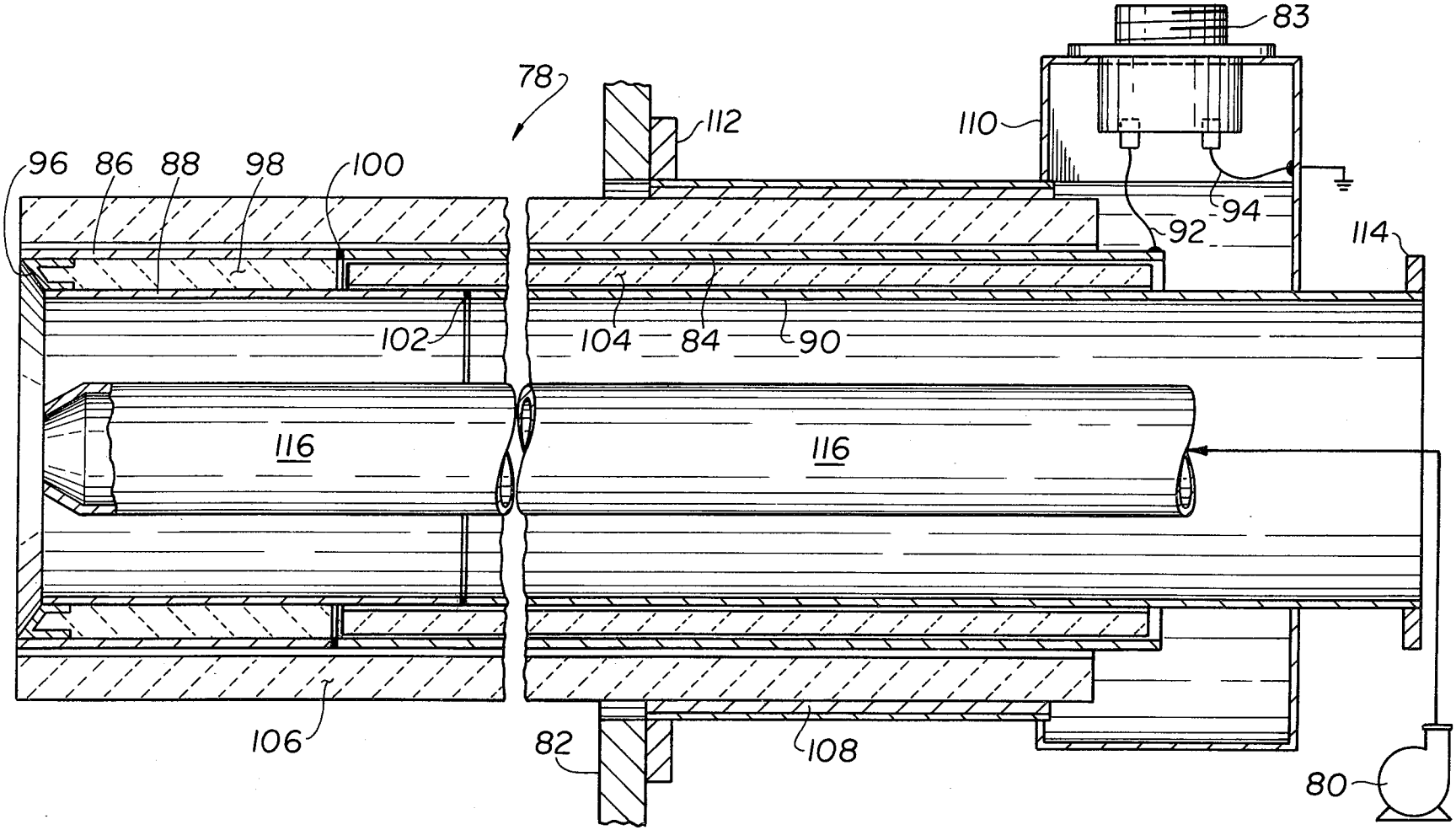

With regard to the embodiment of FIG. 5 the concentric ignitor structure there shown is in the form of an adaptor unit 78 that is connected between a fuel oil supply 80 and a boiler wall 82 of a building furnace. This adaptor unit 78 is provided with an electrical plug 83 to connect the heat control system of the building or furnace to concentric electrodes 86 and 88 via the concentric tubes 84 and 90. Leads 92 and 94 from the plug 83 complete the electrical circuit in the adaptor unit.

As will be readily appreciated by those skilled in the art a power pack or excitor as it may be known to those skilled in the art including the circuitry of FIG. 2 will be connected in the control circuit to provide the required energy to be released by an arc from electrode 86 to electrode 88 across the annular semiconductor tip 96 between the electrodes 86 and 88 at the end of a ceramic insulator ring 98 that, as in the other embodiments aforedescribed, unites the assembly of the electrodes 86 and 88.

The adaptor unit tubes 84 and 90 are electrically connected via weld rings 100 and 102, respectively, to the electrodes 86 and 88 at spaced intervals along the length of the unit 78. Prior to such assembly of the outer tube 84, however, a loose fitting ceramic sleeve 104 is placed over the tube 90.

Thereafter, a ceramic sleeve 106 is loosely fitted over tube 84 and the electrode 86 with a metal sleeve 108 bonded thereto to support the rear housing 110 and mounting flange collar 112. The unit has welded to tube 90 a flange 114 to permit assembly to the fuel source 80, whose fuel-oil delivery pipe is extended by pipe 116 to terminate within the plane of the tip of one of the concentric electrodes 86 or 88.

The foregoing structures will perform as a power arc, non-fouling, inextinguishable, high energy ignitor for all common oil and gas fuels. It is intended that it provides around twelve joules of energy of approximately three to six microseconds duration pulsating in one instance at fifteen times per second. It should be understood the pulsations could be of a different sequence. Also the materials of the electrodes and conductive path are chosen from those that will provide a life cycle in such environment of practical duration and predictability as familiar to those skilled in the art. One especial point, however, is that the conductive facing at the tip is either a semiconductor coating or ring, as desired for the best usage.

In these preferred embodiments it is desired to use a low contaminent oil, i.e., No. 2, so as to insure insulation between various tubes carrying differing potentials with which oil may come in contact.

Having described an operative arrangement of structure for this invention, the protection desired by these Letters Patent is now set forth in appended claims as shall now follow.

I claim:

1. A power arc ignitor comprising:

a fuel nozzle, said nozzle being constructed from concentric metal tubes spaced by a ceramic insulator body;

a means to terminate the insulator body with a semiconductive surface to provide a conductive path across an end of the insulator body from an outer one of the tubes to an inner one of the tubes;

means to deliver fuel to the inner one of said tubes to flow therethrough; and means to controllably connect a high energy positive potential to the inner tube and a ground potential to the outer one of the tubes to originate an electrical arc pulsation from the inner to the outer of said concentric tubes across said conductive path at the end of the insulator body.

2. A power arc ignitor fuel nozzle comprising:

a first conductive tube of a predetermined diameter and of a finite length;

a second conductive tube of a diameter greater than said first tube and of a finite length;

a core between said first tube and said second tube uniting same in an assembly, said core having an insulator portion and a conductive portion that will conduct electric energy between said first tube and said second tube;

a means to deliver fuel from said first tube; and a means to provide light-off energy at the point of delivery of said fuel from said first tube, said means including apparatus to connect a high energy positive potential to said first tube and a ground potential to said second tube.

3. The structure of claim 2 and further characterized by structuring the second tube longer than said first tube with said conductive portion fairing the two in assembly to provide for expansion of the fuel stream across the fuel nozzle tip through the power arc from the first tube to the second tube.

4. A high energy device for igniting a fuel which comprises:

an inner cylindrical metal pipe;

means electrically grounding said inner pipe;

an intermediate cylindrical semi-conductor element, said element being concentrically disposed about and spaced from said inner pipe;

an outer cylindrical metal pipe, said outer pipe being concentrically disposed about and spaced from said element;

means to impress a high voltage electrical potential into said outer pipe, whereby an ignition arc spark is formed on said element between said inner and outer pipes;

insulator means external to said outer pipe; and means to pass a fuel in contact with a surface of said intermediate element, so that said fuel may be ignited and burned.

5. The device of claim 4 in which the means to impress a high voltage electrical potential into said outer pipe comprises a capacitor discharge ignition system.

6. The device of claim 4 in which the inner and outer pipes are composed of stainless steel.

7. The device of claim 6 in which the stainless steel is type 304 or type 316 stainless steel.

8. The device of claim 4 in which the intermediate element is composed of ceramic.

9. The device of claim 4 in which the insulator means is a cylindrical ceramic element concentrically disposed external to and about the outer pipe.

10. The device of claim 4 together with means to pass a fuel into the inner pipe, so that the fuel passes over the sparking area of the spark device, whereby the fuel is burned and a flame emanates from one end of the inner pipe.

11. The device of claim 10 in which the fuel passage means a means to centrally pass the fuel longitudinally through the inner pipe.

12. The device of claim 10 in which the fuel is a liquid or particulate solid fuel, and the fuel is dispersed in discrete particulate form in the inner pipe.

* * * * *